United States Patent [19]

Corominas

[11] Patent Number: 4,641,691

[45] Date of Patent: Feb. 10, 1987

[54] BULK MEAT FEED MACHINE

[75] Inventor: Narciso L. Corominas, Besalu, Spain

[73] Assignee: Metalquimia, S.A., Gerona, Spain

[21] Appl. No.: 613,390

[22] Filed: May 23, 1984

[30] Foreign Application Priority Data

May 27, 1983 [ES] Spain ..... 523.080

[51] Int. Cl.[4] ..... B65B 1/22; B65B 3/12

[52] U.S. Cl. ..... 141/73; 141/12; 141/59; 141/259; 141/248; 222/233

[58] Field of Search ..... 141/69, 71, 73, 81, 141/11, 12, 67, 249, 37, 39, 47, 59, 60, 313, 10, 165, 166, 172, 255, 251, 256, 259, 260, 368, 234, 248, 379, 97; 53/510, 168, 266 R; 222/227, 233-235

[56] References Cited

U.S. PATENT DOCUMENTS

| | | | |
|---|---|---|---|
| 3,288,177 | 11/1966 | Clark | 141/73 |
| 3,563,168 | 2/1971 | Doninger | 141/249 X |
| 3,613,558 | 10/1971 | Math | 141/71 X |
| 3,694,992 | 10/1972 | Hunt | 141/12 X |
| 3,795,084 | 3/1974 | Richardson et al. | 141/71 X |
| 3,872,784 | 3/1975 | Kaszuba et al. | 141/73 |
| 3,980,109 | 9/1976 | Trueman et al. | 141/71 |
| 4,167,203 | 9/1979 | Tschersich et al. | 141/59 |
| 4,448,227 | 5/1984 | Zanichelli | 141/57 |

*Primary Examiner*—Charles E. Phillips
*Assistant Examiner*—Ernest G. Cusick
*Attorney, Agent, or Firm*—Holman & Stern

[57] ABSTRACT

A bulk meat feeding machine including a head member attached to the support base of a main feeding machine has a main feeding channel therein, the improved head member having a cavity therein connected to the outlet end of the main feeding channel, a sweeping blade rotatably mounted in the cavity, two outlet openings in the cavity connected with two spaced linear passageways having plungers therein which push the product through a bell-shaped cover attached to the head member and into alveolate form containers sealingly connectable to the bell-shaped cover. A pushing plunger is provided in the main feeding channel to push the product into the cavity and is thereafter alternately pushed through the two openings by the sweeping action of the blade driven by a rotating drive member.

4 Claims, 6 Drawing Figures

BULK MEAT FEED MACHINE

BACKGROUND OF THE INVENTION

1. Field of the Invention

This invention relates to improvements in a bulk meat feed machine basically in the area of supply, i.e., filling or loading of containers with the product located at the extreme end of the feed passage.

2. Description of the Prior Art

Machines are known for filling of alveolate-type containers formed from laminar bands of plastic material using an automatic thermoforming machine for making the containers in which, starting with two laminar pieces of the type stated in a superimposed position and by using a deformation station employing thermopneumatic methods, the alveoliform containers are fabricated. After passing through the thermoforming stage, they reach a table or horizontal plane where the alveolate containers still joined together as pairs move linearly, this being the zone where they are filled with product through a feed nozzle with final closure being carried out under vacuum in another part of the unit.

BRIEF SUMMARY OF THE INVENTION

Loading of the alveolate containers by the machine of this invention is also done in a vacuum to ensure that the bulk meat does not absorb particulate matter from the air during this process which might prejudice its conservation at a later date.

To this end, the improvements consist of substituting for the known changeable structure or accessory in the extreme area of the feeding unit a head which, placed as a continuation of the supply channel of the bulk meat feed mechanism, is arranged to supply the material coming from each feed in a vertical direction by means of plungers operated by linear hydraulic motors, feeding the said alveolate containers placed horizontally, the head being supplied with a bell-shaped top which simultaneously covers two alveolate containers in such a way that it can be adjusted over the periphery of the containers. When the surface of the table which carries these is raised slightly, it hermetically closes the cavities to allow extraction of the interior air from the containers and from the interior part of the head, the duration of this phase being controlled by timing mechanisms which then reactivate the feed cycle.

In the main body of the machine the overall unit is adapted to the characteristics of the new performance to be obtained, i.e., basically the configuration of the extreme plunger of the feed cavity as well as the operations panel where the working interrelation with the action of the abovementioned head is controlled.

The invention also provides an easy disassembly feature as well as very simple access to any part of the inside of the head resulting in a reduction in time and labor required in maintenance work for the unit which furthermore need not be of a specialized nature as well as a definite guarantee of efficiency in cleaning.

In essence, the improvements which satisfy the objects of the invention include at the extreme end of the feed supply channel a large, substantially cylindrical cavity, with one side cut off by a rectangular plane, shaped like a sector of a circle with a surface slightly larger than a semi-circumference which joins the feed channel on one side of the cavity, and an extension plunger or dummy attached to the extreme end of the product supply plunger ending in a concave shape so that, at its position of maximum extension or end of stroke, the end of the plunger makes a perfect conjunction with the wall of the cavity. On its flat side the cavity has two outlets on both sides of an axis installed on the plane and these allow passage of two vertical conduits, used for loading of product in the alveolate containers, in which are installed the relative hydraulic plungers. The axis which coincides with the geometric center or stroke, of the ideal circumference, where the bottom of the cavity is located is operationally interrelated with a rotating cylinder or piston and has fixed to a rectangular blade which extends until it fits closely with the outside edge of the area of revolution and which in consequence and in virtue of its movement establishes a selective movement toward one or the other of the two outlets which are arranged on the vertical wall and in its next rotational movement drives the bulk meat supply which has not reached the outlet passage with a motion of the plunger in the feed section thereby emptying the cavity completely of product.

The side wall of the vertical passageways, which are each equipped as has been explained with linear hydraulic motor powered plungers to push the bulk meat towards the alveolate containers to be loaded, is formed by a removable plate to allow direct access to the said passageways and also to the cavity during the essential periodic cleaning operations.

In its lower section, the plate is equipped transversely with a wide bell-shaped cover of rectangular form which, in a horizontal position, completely covers a pair of alveolate containers over which it is superimposed a short space in the operating position, this cover being equipped with two vertical openings or conduits aligned with the vertical passageways for the product and equipped at the perimeter with a continuous resilient or elastic gasket to ensure a hermetic seal when superimposed on the periphery of the alveolate containers which takes place, as indicated earlier in the general statement of the working cycle of the unit, due to raising the table, or conveyor band, for the alveolate containers against the said cover. From that moment and always before the operation of the feed cycle, extraction of the air in the cavity, the passageways and the alveolate forms is carried out by a vacuum pump which forms part of the unit, the operation of which has a pre-established duration controlled by timing regulators which, following this operation, activate the supply of product to the said cavity.

The outlet for the extraction of air from the alveolate forms, the cavity and the interior passageways of the head passes through the cover by means of a duct provided with leak-proof seals in the section coupled to the cover and this duct connects in turn with a tube supported on the interior side of the cover to make a closed circuit surrounding the double central passage. In the preferred embodiment this is a rectangular form but it could be adapted to any other suitable closed configuration. The tube has a number of spaced openings for the extraction of air in order to distribute the vacuum effect uniformly at all points of the interior of the space enclosed by the cover. The tube is also formed by two half-sections which can be hooked together to very easily facilitate their disconnection and in this way contribute to simplifying the cleaning of that part of the unit.

BRIEF DESCRIPTION OF THE DRAWINGS

For a better understanding of the characteristics of the invention, there will now be described in greater detail preferred embodiments of the bulk meat feeding machine thereof with reference to the accompanying drawings wherein.

DETAILED DESCRIPTION

Figure 1:
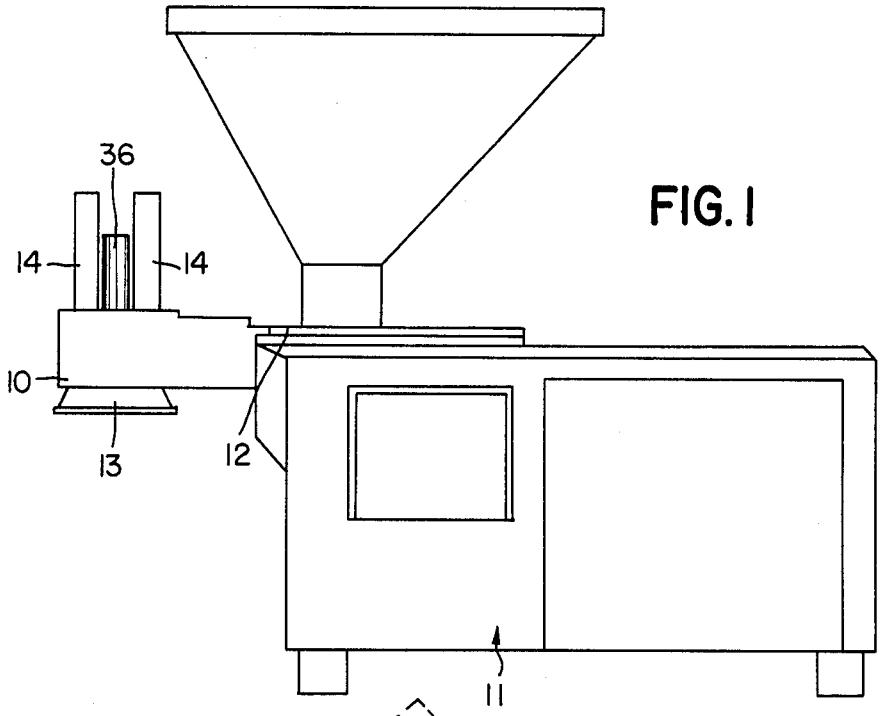
FIG. 1 is a schematic side elevational view of the overall machine showing the structure of the head for loading of product.
Figure 2:
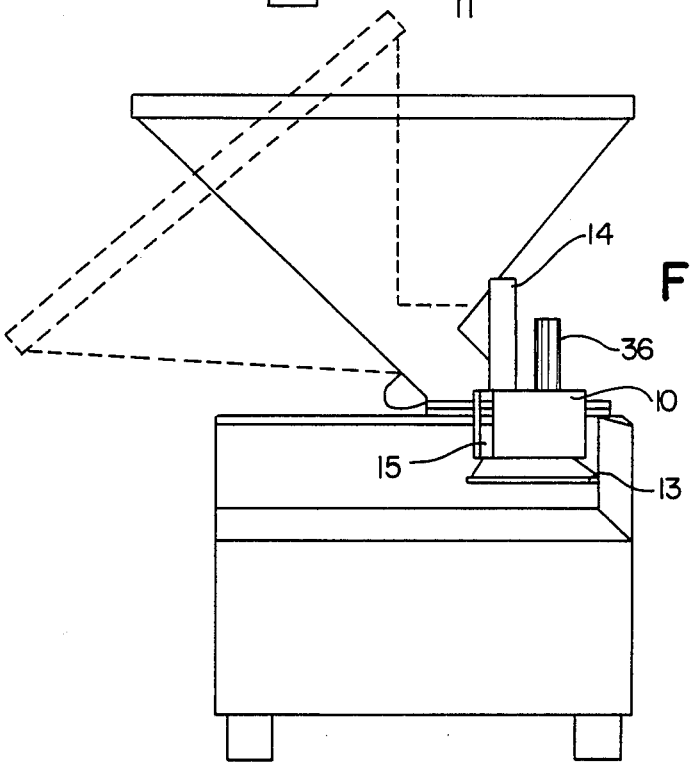
FIG. 2 is a left side elevational view of FIG. 1 showing that one of the sides of the head is formed by a plate which incorporates at its lower end a bell-shaped cover.

The invention relates substantially to details of structure and operation of the head 10 attached to the overall machine 11 and located in the extreme section of the feed channel. The head 10 is composed of a lower section having the form of a bell-shaped cover 13 intended to fit hermetically over the open alveolate forms to be filled by means of vertically oriented hydraulic plungers 14 slidable in passageways 17, 17' in head 10 and openings 31 (FIG. 4) in the said cover 13. This cover 13 is joined to a plate 15 which makes up the side of a cavity 16 and more exactly the wall of the vertical passageways 17, 17' for feeding the product, which passageways are positioned to the side of the cavity 16.

Figure 3:
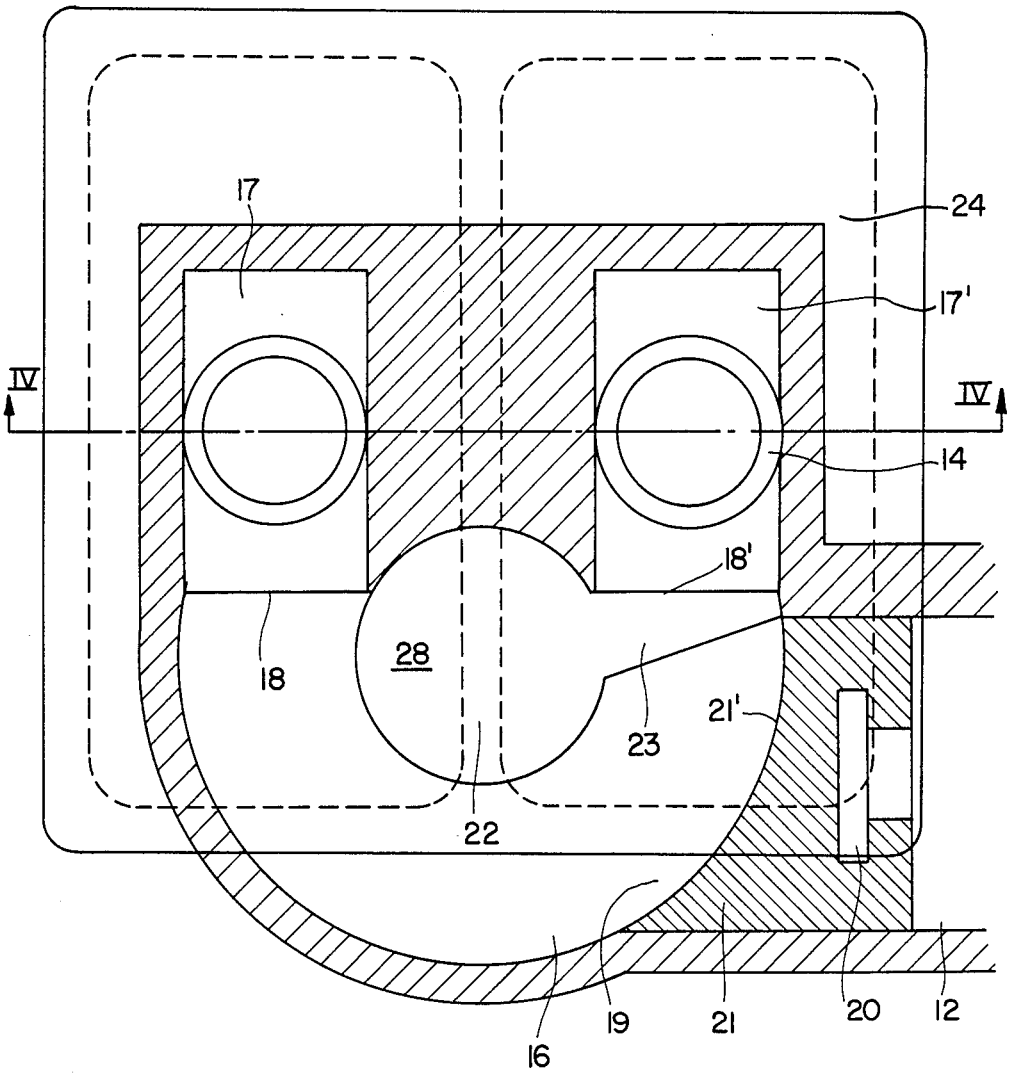
FIG. 3 is a cross-sectional view of the interior cavity of the head and the extreme end of the feed channel and also shows in broken lines the outline of the two alveolate containers to be filled by means of this unit situated below and with the vertical passageways lined up with the central part of the alveolate forms.

The cavity 16 is bounded by a truncated turning surface with a flat rectangular side in which are two outlets 18 and 18' which provide access for the vertical passageways 17, 17' (see FIG. 3). Communication between the feed section 12 and the cavity 16 is by means of a lateral passageway 19 and a pushing plunger 20 of the machine which has a part 21 which has a concave end 21' to fit neatly to the substantially cylindrical configuration of the cavity wall 16 in the area where the said passageway 12 emerges.

At a side point in the chamber 16 on an axis 22 a turnable member having a hub portion 28 and a blade 23 is installed so as to be rotatably supported in head 10 about a center axis of the hub 28 and is connected to a rotating piston or motor device of conventional type schematically shown at 36 positioned in such a way that it rotates the blade 23 to close and open selectively one or another of the passages or outlets 18, 18' so that after the plunger 20 reaches its maximum position of movement (corresponding to the position shown in FIG. 3) the blade 23 begins to turn through an arc greater than 180° pushing part of the bulk meat which has not reached the vertical passageway 17 by means of the outlet 18, thereby closing the outlet 18 and coming to a position where it ensures that the later feeding of the product now takes place through the other outlet 18'.

That is to say that the blade 23 fulfils a distribution function for the bulk meat supplied from the section 12 to one or the other of the alveolate forms 24 for loading, in relation to which this unit moves into an overhead position and furthermore carries out an efficient cleaning off of the material which is supplied in each case to the cavity 16, largely passing toward the vertical passageways 17'.

Figure 5:
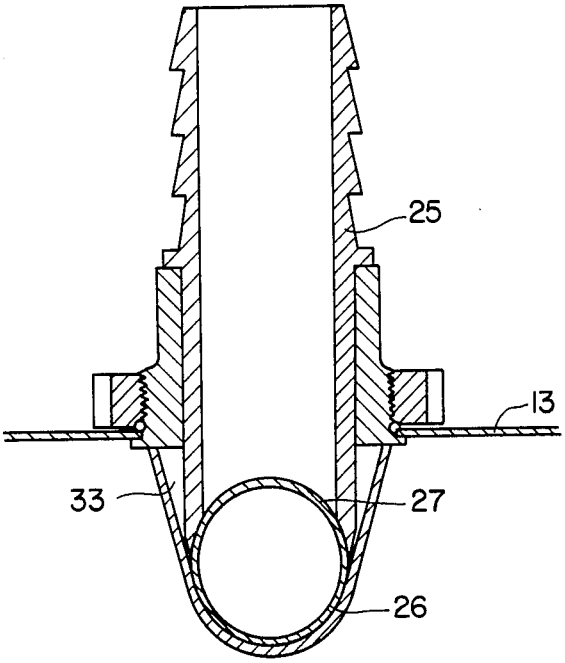
FIG. 5 is a cross-sectional view of the coupling section through the cover conducting tubing connected to a vacuum pump for the extraction of the interior air from the alveolate forms, passageways and internal cavity of the head.
Figure 6:
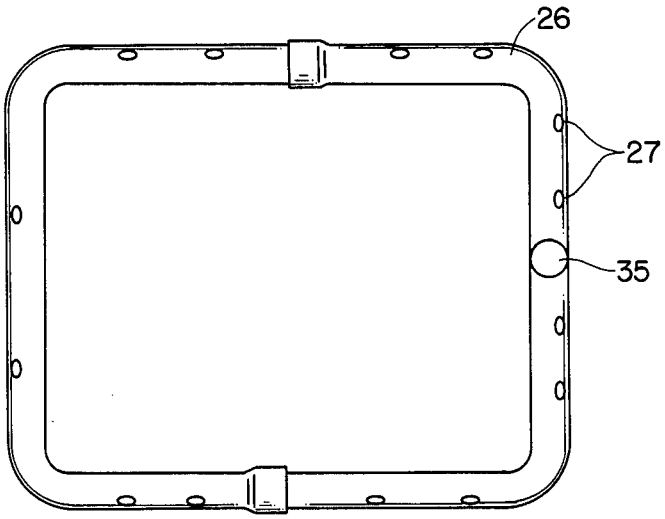
FIG. 6 is a plan view showing the rectangular configuration of the tubular section connected with the vacuum and which can be dissassembled.

FIG. 5 shows the interelation through the cover 13 of the intake 25 (with leak-proof coaxial connections) joined at one end to a vacuum pump (not shown) for the extraction of air from the alveolate forms 24, the passageways 17, 17' and the interior of the chamber 16, according to the sequence previously explained. The other end of intake 25 is joined to the tube 26 at hole 35, tube 26 being supported on the inner wall of the cover 13 by brackets 33. The tube 26 has a substantially rectangular shape (see FIG. 6) and several openings 27 linearly spaced for distributing the suction effect along the whole upper third of the volume of the alveolate forms 24.

Figure 4:
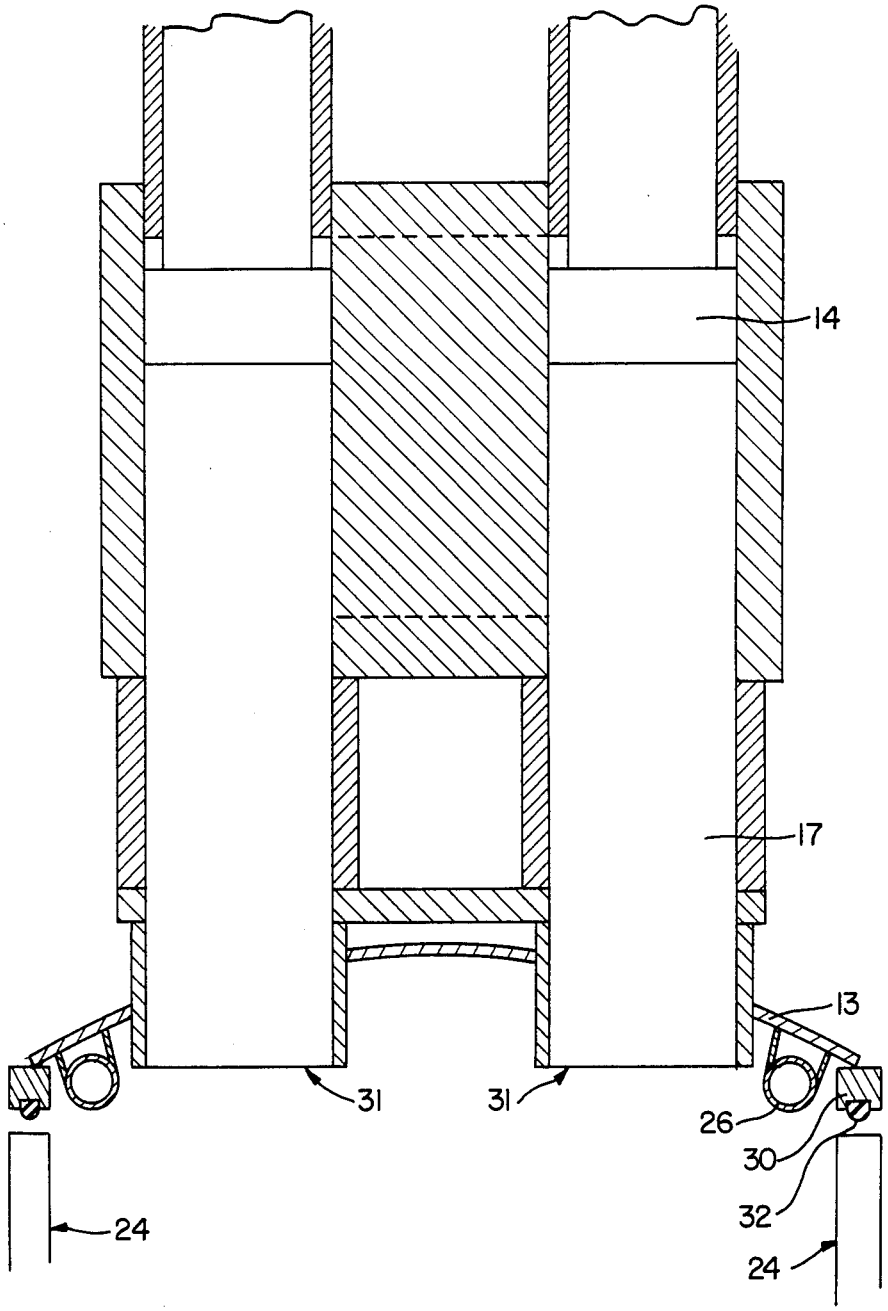
FIG. 4 is a cross-sectional view taken along line IV—IV of FIG. 3 showing the two vertical passageways which form part of the head as well as the attached cover of the removable plate which forms the side and bottom of the said head and the tubular section to which is connected the vacuum outlet which surrounds the two vertical passages.

FIG. 4 shows the lower rim 30 of cover 13 and the continous resilient or elastic gasket 32 mounted and supported thereon for sealing against the upper edge of the alveolate container shown schematically at 24.

I claim:

1. A bulk feeding machine having a support frame and a feeding means on the support frame for feeding bulk material to a feeding station for dispensing the material into containers, comprising:

feeding channel having an outlet through which material is fed to the feeding station;

a feeding head supported on the support frame adjacent said outlet of said feeding channel;

a cylindrical cavity in said feeding head having a cross-sectional configuration in the form of a circular segment portion which has an arc which is slightly greater than a semi-circle and which has a generally flat side portion, said circular segment portion communicating with said outlet of said feeding channel;

a first piston-type plunger reciprocably operable in said feeding channel to push material therethrough toward said outlet of said feeding channel;

two spaced openings in said flat side portion;

two passageways in said feeding head, each communicating with one of said two spaced openings and each of two said spaced passageways having an outlet;

said circular portion of said cavity having a central axis;

a blade member rotatably mounted in said cavity about a blade member axis that is coaxial with said central axis of said circular portion of said cavity, said blade member having such dimensions and such a shape as to, at each end position of its travel, at least substantially close one of said two spaced openings;

a means to rotate said blade member alternately in opposite directions within said cavity about said blade member axis so that material fed through said feeding channel outlet into said cavity is pushed, by said blade member when operated alternately, toward and through said openings;

a second and a third piston-type plunger slidably disposed reciprocation in respective ones of said two passageways;

a means to reciprocate said second and third plungers alternately in said two passageways to push material entering therein through said two spaced openings toward said respective said outlets of said two passageways;

a bell-shaped cover member mounted on said feeding head;

two outlet conduits extending through said cover member and aligned with respective ones of said two passageways to conduct material fed through said two passageways to the containers;

a seal means on said cover member adapted to be cooperatively engageable with the containers for sealing the inside of the containers, said two passageways, and said cavity;

a means for producing a vacuum inside of said cover member, said two passageways, and said cavity;

a concave curved inner end disposed on said first piston-type plunger, said concave curved inner end conforminging to the inner end surface of said circular portion of said cavity; and said blade member extending radially in said cavity, and having an outer edge closely spaced to the inner surface of said circular portion.

2. A bulk feeding machine as claimed in claim 1 wherein said means to produce a vacuum comprises:

a tubular member adjacent the inner surface of said cover member;

a bracket means attached to said cover member and to said tubular member to support said tubular member;

a vacuum opening through said cover member, and an opening in said tubular member;

an adapter fitting extending through said vacuum opening in sealing relationship therewith and having an inner end sealingly connected to said opening in said tubular member, and an outer end adapted to be connectable to a vacuum pump; and a plurality of vacuum distribution holes linearly spaced along said tubular member.

3. A bulk feeding machine as claimed in claim 2 wherein:

said bell-shaped cover member has a rectangular configuration;

said tubular member has a rectangular shape; and said tubular member is comprised of two U-shaped members removably connected together at their ends.

4. A bulk feeding machine as claimed in claim 1, wherein said blade member comprises:

a central cylindrical hub portion rotatably mounted in said feeding head, and a blade portion extending from said hub portion having a truncated cross-sectional shape, the larger base of which is disposed at the hub end.

* * * * *